US006884950B1

(12) United States Patent
Nicholson et al.

(10) Patent No.: US 6,884,950 B1
(45) Date of Patent: Apr. 26, 2005

(54) MEMS SWITCHING SYSTEM

(75) Inventors: Dean B. Nicholson, Windsor, CA (US); Eric R. Ehlers, Santa Rosa, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/941,494

(22) Filed: Sep. 15, 2004

(51) Int. Cl.[7] ..... H01H 57/00

(52) U.S. Cl. ..... 200/181; 310/309

(58) Field of Search ..... 310/309; 200/181

(56) References Cited

U.S. PATENT DOCUMENTS 6,388,359 B1 * 5/2002 Duelli et al. ..... 310/309

* cited by examiner

*Primary Examiner*—Ramon M. Barrera
(74) *Attorney, Agent, or Firm*—John L. Imperato

(57) ABSTRACT

A MEMS switching system includes a power diverter interposed between a signal source and a bank of MEMS switches. The power diverter has an activated state wherein signal power from the signal source is diverted from the bank of MEMS switches, and a deactivated state wherein signal power from the signal source is not diverted from the bank of MEMS switches. A control signal selects between the activated state and the deactivated state of the power diverter.

20 Claims, 5 Drawing Sheets

MEMS SWITCHING SYSTEM

BACKGROUND OF THE INVENTION

Contact switches formed in MEMS (Micro-Electro-Mechanical Systems) technology are well-suited for switching broadband signals. For example, MEMS switches can provide switching of signals covering frequencies from DC to over 20 GHz. MEMS switches have smaller physical size and higher switching speed than conventional electromechanical switches. MEMS switches also have lower insertion loss in the ON state, higher isolation in the OFF state, and lower distortion in both the ON and OFF states than conventional high frequency semiconductor switches. MEMS switches have high reliability when "cold switched", i.e. switched between ON and OFF states, or OFF and ON states, with no signal power applied. When cold switched, MEMS switches can operate reliably for as many as $10^9$ switching cycles.

A significant drawback of MEMS switches is the decreased reliability that results when the MEMS switches are "hot switched", i.e. switched between ON and OFF states, or OFF and ON states, when signal power is applied to the MEMS switches. While reliability of the MEMS switches typically has an inverse relationship to the level of the signal power that is applied during switching, the reliability of the MEMS switches can rapidly decrease when the signal power applied during switching is greater than a threshold power level that depends on the type of MEMS switch. At applied signal power levels that are greater than the threshold power level, the number of switching cycles of reliable operation can decrease substantially.

SUMMARY OF THE INVENTION

A MEMS switching system according to the embodiments of the present invention includes a power diverter interposed between a signal source and a bank of MEMS switches. The power diverter has an activated state wherein signal power from the signal source is diverted from the bank of MEMS switches, and a deactivated state wherein signal power from the signal source is not diverted from the bank of MEMS switches. A control signal selects between the activated state and the deactivated state of the power diverter.

DETAILED DESCRIPTION OF THE EMBODIMENTS

Figure 1A:
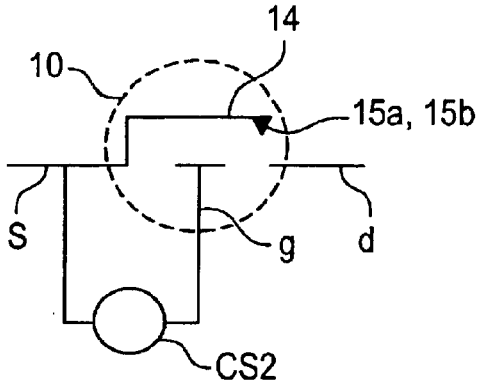
FIGS. 1A–1C show alternative views of a MEMS switch suitable for inclusion in the MEMS switching system according to the embodiments of the present invention.
Figure 1B:
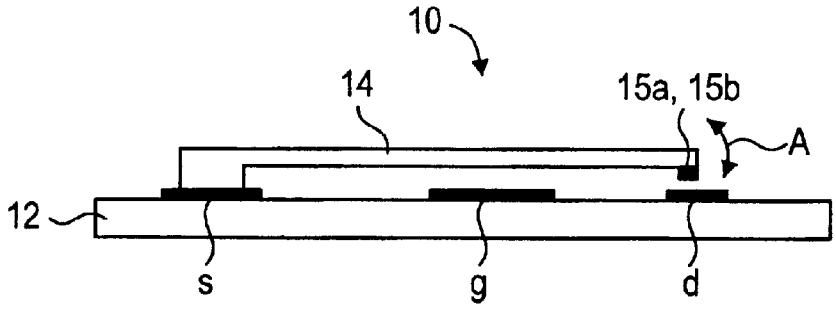
Figure 1C:
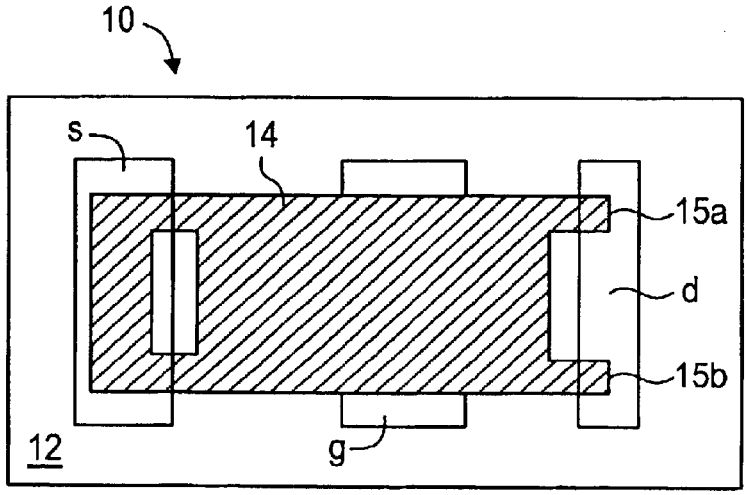

FIGS. 1A–1C show alternative views of a MEMS switch 10 suitable for inclusion in a MEMS switching system 20 (shown in FIG. 2) according to the embodiments of the present invention. FIG. 1A shows a schematic representation of the MEMS switch 10. FIG. 1B shows a side view of the MEMS switch 10. FIG. 1C shows a top view of the MEMS switch 10. MEMS switches 10 are typically fabricated on a GaAs, quartz or a high-resistivity silicon substrate 12. MEMS switches are commercially available from Radant MEMS, Inc., DOW-KEY Microwave Corp., or other sources. The switching elements of the MEMS switch 10 shown in FIGS. 1A–1C include a cantilevered beam 14 and a switch contact d formed on the substrate 12. The cantilevered beam 14 and switch contact d are typically formed from micro-machined metal, or micro-machined silicon with included regions of metal plating. The cantilevered beam 14 includes fingers 15*a*, 15*b* that extend from the free end of the cantilevered beam 14. The cantilevered beam 14 is deflected according to a control signal CS2 typically applied between a terminal g, and a terminal s that is connected to the cantilevered beam 14. In the "ON" state, or closed state, the cantilevered beam 14 is deflected so that the fingers 15*a*, 15*b* make contact with the switch contact d. In the "OFF" state, or open state, the cantilevered beam 14 is deflected so that the fingers 15*a*, 15*b* of the cantilevered beam 14 do not make contact with the switch contact d. The control signal CS2 deflects the cantilevered beam 14 as shown by directional arrow A, typically via an electrostatic force, magnetic force, or via piezo-electric action. In the MEMS switch 10 shown in FIGS. 1A–1C, the cantilevered beam 14 is deflected via an electrostatic force that results from a voltage across the terminals g, s, provided by the control signal CS2. In this example, a voltage of approximately 40 volts between the terminal g and the terminal s is sufficient to deflect the cantilevered beam 14 and switch the MEMS switch 10 between the ON state and the OFF state, or the OFF state and ON state. The small physical size of the MEMS switch 10 and the low contact resistance between the fingers 15*a*, 15*b* of the cantilevered beam 14 and switch contact d make the MEMS switch 10 well-suited for switching signals that cover a broad frequency range. To limit interactions between the control signal CS2 that deflects the cantilevered beam 14 and signal power that may be present at the terminal s, a high impedance element (not shown), such as a resistor or inductor, is typically placed in the signal path of the control signal CS2. Blocking capacitors can be included to prevent DC voltages that are external to the MEMS switch 10 from influencing the switching of the MEMS switch by the control signal CS2. In alternative types of MEMS switches, the control signal CS2 is electrically isolated from the cantilevered beam 14 by dielectric regions on the cantilever beam 14. These latter types of MEMS switches 10 accommodate signal power at DC, even in the absence of blocking capacitors.

Figure 2:
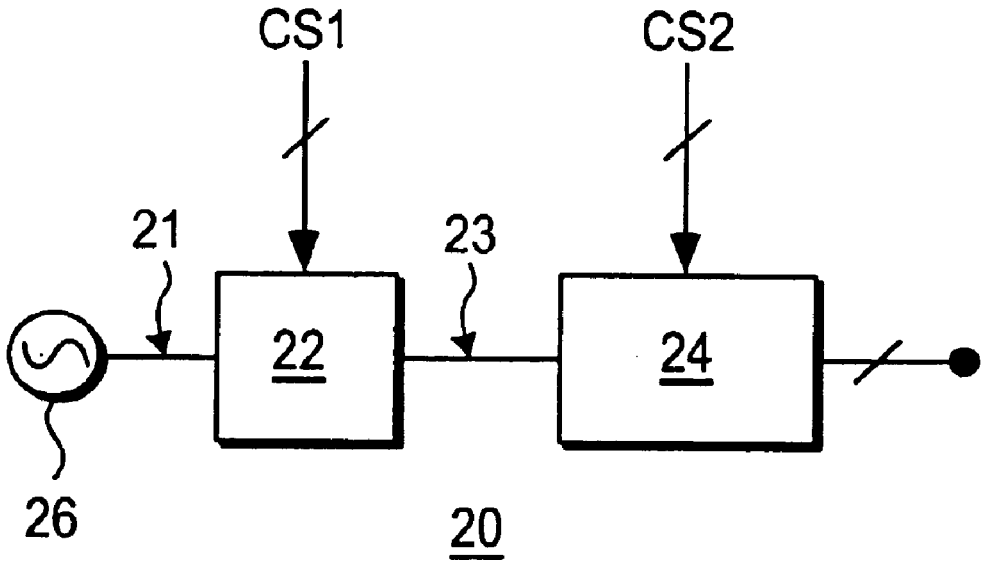
FIG. 2 shows a block diagram of a MEMS switching system according to embodiments of the present invention.

FIG. 2 shows a block diagram of the MEMS switching system 20 according to embodiments of the present invention. The MEMS switching system 20 includes a power diverter 22 cascaded with a bank of MEMS switches 24 including one or more of the MEMS switches 10. In a typical application of the MEMS switching system 20, the power diverter 22 is interposed between a signal source 26 and the bank of MEMS switches 24. The signal source 26 can be a transmission line guiding an electromagnetic signal, or any other device, element, instrument or system that is capable of providing signal power 21 to the bank of MEMS switches 24. In one example, the signal source 26 provides signal power 21 in the frequency range of DC to 20 GHz. However, the signal power 21 can have a variety of frequency content. The power diverter 22 and the bank of MEMS switches 24 can be separate elements of the MEMS switching system 20 as shown in FIG. 2, or the power diverter 22 and bank of MEMS switches 24 can be integrated onto a monolithic substrate or circuit in the MEMS switching system 20.

The power diverter 22 is typically a reflective or absorptive device, element or circuit, that reduces or otherwise limits "hot switching" of the MEMS switch 10 when the power diverter 22 is activated by a control signal CS1. Hot switching results when one or more of the MEMS switches 10 in the bank of MEMS switches 24 changes connection states with signal power present on the cantilevered beam 14 or the switch contact d. Hot switching is reduced or limited in the MEMS switching system 20 by having the power diverter 22 in the activated state during the time that the switching states of the one or more MEMS switches 10 in the bank of MEMS switches 24 are changed. In the activated state, the power diverter 22 reflects or absorbs signal power 21 that in a deactivated state of the power diverter 22 would be incident on the bank of MEMS switches 24. This diversion of signal power 21 by the power diverter 22 substantially reduces the signal power 23 that is incident on the bank of MEMS switches 24. Reducing this signal power 23 during switching of the MEMS switches 10 in the bank of MEMS switches 24 typically improves reliability of the MEMS switches 10. When the signal power 21 provided by the signal source 26 is less than a predetermined or otherwise designated maximum power level, the signal power 23 incident on the bank of MEMS switches 24 can be kept below a threshold power level via activation of the power diverter 22. The threshold power level can be designated to be sufficiently low to provide reliable operation for the particular type of MEMS switches 10 included in the bank of MEMS switches 24. In one example, the threshold power level is designated to be 5 dBm.

Figure 3A:
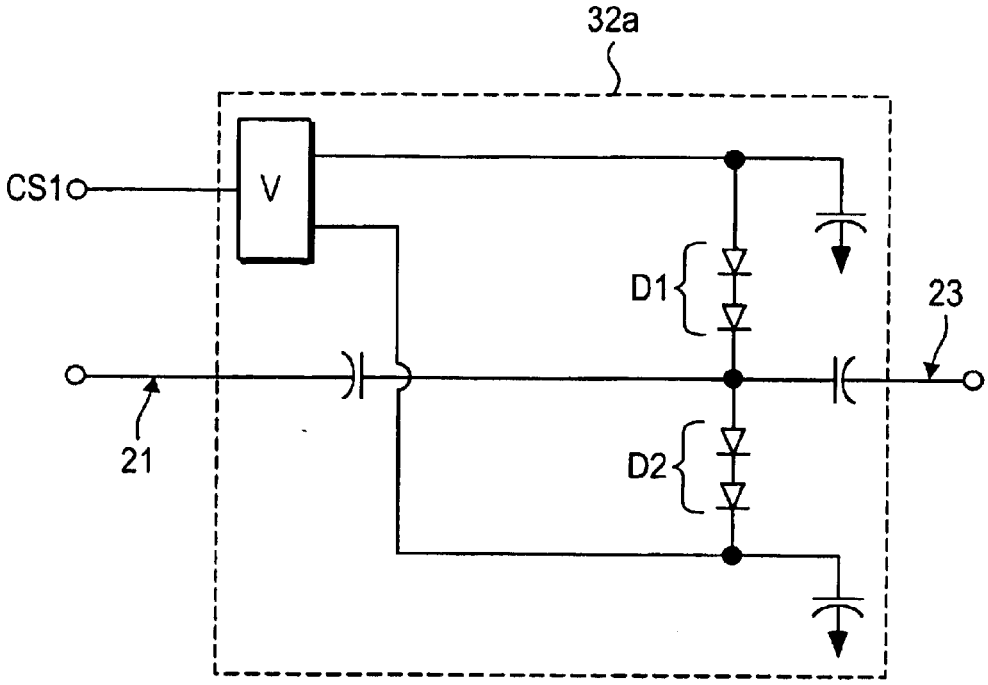
FIGS. 3A–3B show alternative power diverters suitable for inclusion in the MEMS switching system according to embodiments of the present invention.
Figure 3B:
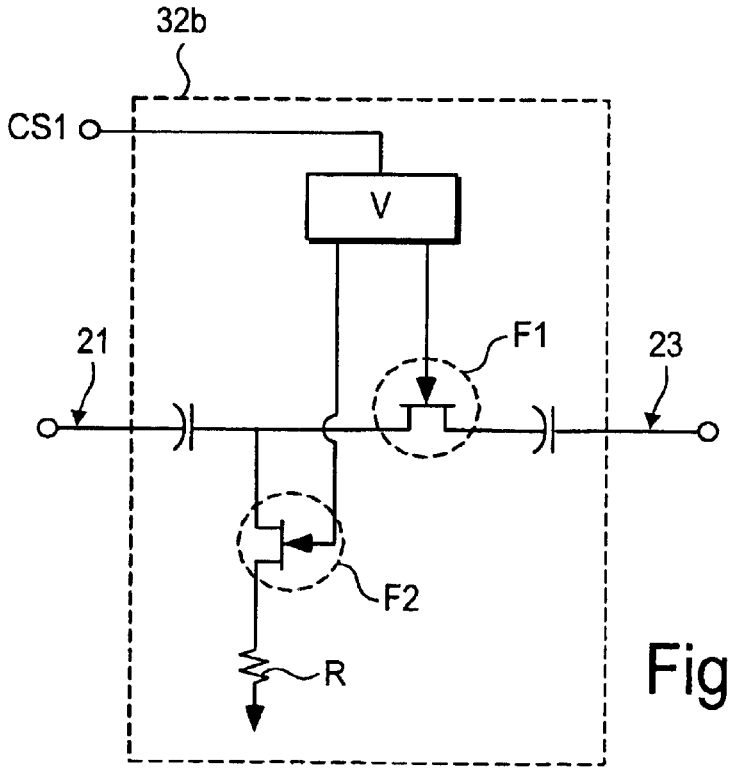

FIGS. 3A–3B show power diverters 32*a*, 32*b*, which are exemplary implementations of the power diverter 22 included in the MEMS switching system 20, according to alternative embodiments of the present invention. The power diverter 32*a* in FIG. 3A includes a pair of diode stacks D1, D2 shunt coupled to a signal path between the signal source 26 and the bank of MEMS switches. The pair of diode stacks D1, D2 are activated by the control signal CS1. While the power diverter 32*a* is shown with two diode stacks D1, D2, each having two diodes, the power diverter 32*a* is alternatively constructed using one or more diodes in each of the diode stacks D1, D2, or using a multiplicity of each of the diode stacks D1, D2 in parallel arrangements. The diodes in the pair of diode stacks D1, D2 are typically PIN diodes, Schottky diodes or modified barrier diodes, although other devices or elements that have variable impedance states are also suitable for use in the power diverter 32*a*. In this example, the control signal CS1 provides a voltage V that forward biases or reverse biases the pair of diode stacks D1, D2 depending on the polarity of the voltage V.

When the voltage V has the polarity that reverse biases the pair of diode stacks D1, D2, signal power 21 from the signal source 26 is delivered to the bank of MEMS switches 24. In this deactivated state of the power diverter 32*a*, wherein the diodes in the pair of diode stacks D1, D2 are reverse biased, the power diverter 32*a* has low insertion loss and introduces low distortion to the signals that are incident on the bank of MEMS switches 24. The voltage V reduces distortion to a minimum level or to another sufficiently low level by providing a sufficiently high reverse bias to the pair of diode stacks D1, D2. When the voltage V provided by the control signal CS1 forward biases the pair of diode stacks D1, D2, the power diverter 32*a* is in the activated state and has a low impedance. This results in an impedance mismatch that causes signal power 21 from the signal source 26 to be reflected back toward the signal source 26, substantially reducing the signal power 23 that is incident on the bank of MEMS switches 24.

The power diverter 32*b* in FIG. 3B includes FET switches F1, F2 in a series/shunt arrangement. The FET switches F1, F2 are activated by a control signal CS1. In an activated state of the power diverter 32*b*, the series FET switch F1 is opened and the shunt FET switch F2 is closed. The closed shunt FET switch F2 couples an absorptive load R to the signal power 21 provided by the signal source 26, whereas the opened series FET switch F1 interrupts the signal path between the signal source 26 and the bank of MEMS switches 24. In this activated state of the power diverter 32*b*, the series/shunt FET switches F1, F2 substantially reduce the signal power 23 that is incident on the bank of MEMS switches 24. In an alternative embodiment, the power diverter 32*b* provides a reflective load for the signal power 21 provided by the signal source 26, by coupling the shunt FET switch F2 to ground, or another low impedance point, rather than to the absorptive load R as shown in FIG. 3B.

In a deactivated state of the power diverter 32*b*, the series FET switch F1 in the power diverter 32*b* is closed and the shunt FET switch F2 in the power diverter 32*b* is opened The closed series FET switch F1 connects the signal path between the signal source 26 and the bank of MEMS switches 24, and the opened shunt FET switch F2 disconnects the absorptive load R for the signal power 21 provided by the signal source 26. This results in a low insertion loss connection between the signal source 26 and the bank of MEMS switches 24. In this deactivated state of the power diverter 32*b*, the signal power 21 from the signal source 26 is incident on the bank of MEMS switches 24 through a low insertion loss connection provided by the power diverter 32*b*. While FIG. 3B shows that there are two series/shunt FET switches F1, P2 included in the power diverter 32*b*, the power diverter 32*b* is alternatively implemented using a single series FET switch F1, a single shunt FET switch F2, or other numbers of FET switches in series/shunt configurations.

Blocking capacitors are shown in the power diverters 32*a*, 32*b* to isolate the control signal CS1 from the signal path between the signal source 26 and the bank of MEMS switches 24. In alternative embodiments of the MEMS switching system 20, the blocking capacitors may be omitted, depending on the configuration of the bank of MEMS switches 24, and the particular implementation of the power diverter 22. While the power diverters 32*a*, 32*b* shown in FIGS. 3A–3B are exemplary implementations of the power diverter 22 shown in the MEMS switching system 20 of FIG. 2, in alternative embodiments of the present invention the power diverter 22 is implemented using mechanical switch elements, optically actuated semiconductor switches, or any other switching elements suitable for diverting signal power 21 from the bank of MEMS switches 24 during switching of the MEMS switches 10.

Figure 4:
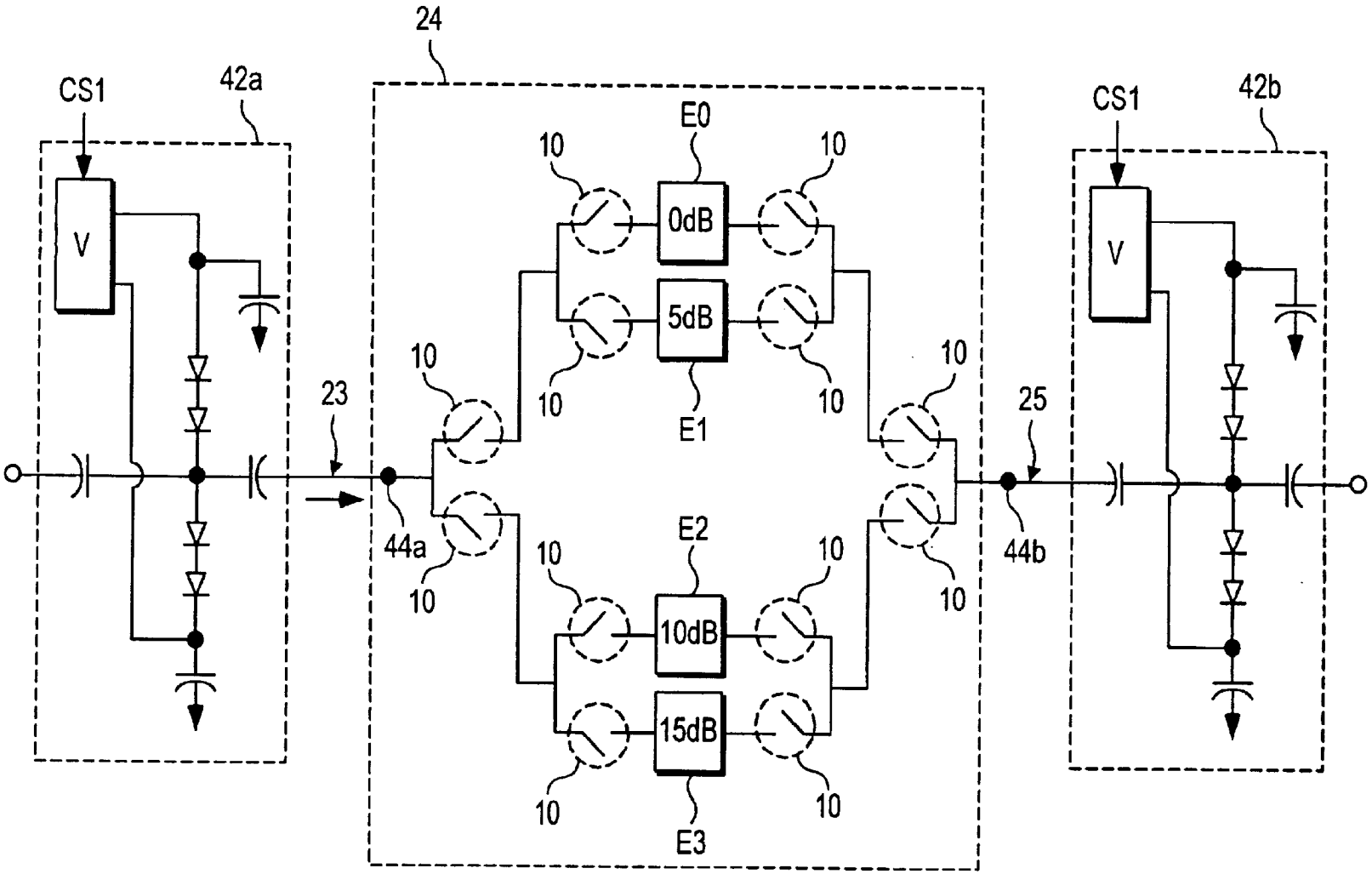
FIG. 4 shows a MEMS-switched attenuator according to embodiments of the present invention.

The bank of MEMS switches 24 shown in FIG. 2 includes one or more MEMS switches 10 in a variety of arrangements or configurations. Typically, the MEMS switches 10 in the bank of MEMS switches 24 are configured in switch networks to route signals between various signal paths, or the MEMS switches 10 are configured as part of circuits or systems that process applied signals. FIG. 4 shows a bank of MEMS switches 24 configured to form a MEMS-switched attenuator 40, according to an embodiment of the present invention. The MEMS-switched attenuator 40 includes one or more attenuator elements E0–E3, multiple MEMS switches 10, and two power diverters 42*a*, 42*b*. The power diverter 42*a* reduces or limits hot switching that could result from signal power 21 incident at a first port 44*a* of the MEMS switched attenuator 40, whereas the power diverter 42*b* reduces or limits hot switching that could result from signal power 25 incident at a second port 44*b* of the MEMS switched attenuator 40. While two power diverters 42*a*, 42*b* are shown included in the MS-switched attenuator 40, the MS-switched attenuator 40 is alternatively constructed with one power diverter at either the port 44*a* or at the power 44*b*.

In the example shown in FIG. 4, the attenuator element E0 is a minimum attenuation through-line, the attenuator element E1 is a 5 dB attenuator, the attenuator element E2 is a 10 dB attenuator, and attenuator element E3 is a 15 dB attenuator. This enables different attenuation levels to be achieved between the ports 44*a*, 44*b* of the attenuator by switching designated ones of the MEMS switches 10 within the bank of MEMS switches 24 according to control signals CS2. For clarity of FIG. 4, the control signals CS2 for the MEMS switches 10 are not shown. The attenuator elements E0–E3 and the configuration of MEMS switches 10 shown in FIG. 4 are an exemplary implementation of the MEMS-switched attenuator 40. However, the MS-switched attenuator 40 alternatively includes any of a variety of configurations of MEMS switches 10 and attenuator elements.

Figure 5:
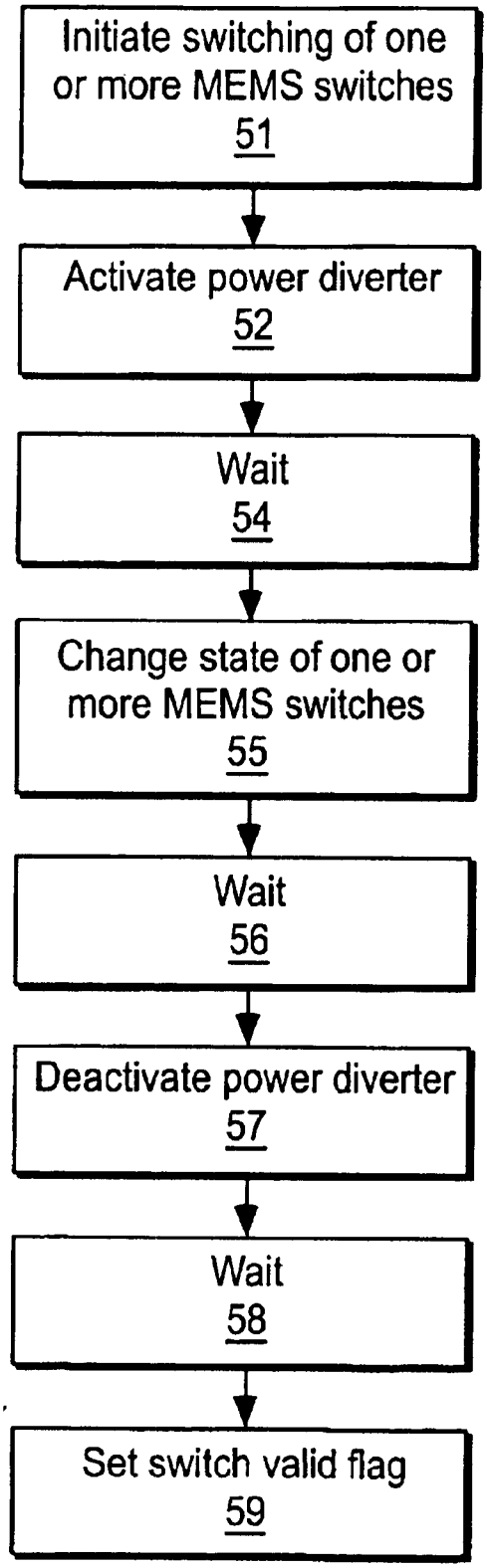
FIG. 5 shows a flow diagram of a MEMS switching sequence according to embodiments of the present invention.

Hot switching of the MEMS switches 10 in the bank of MEMS switches 24 shown in FIG. 2 and FIG. 4 is reduced via sequencing the control signal CS1 to the power diverter 22 and the control signal CS2 to the one or more MEMS switches 10 in the bank of MEMS switches 24. FIG. 5 shows a flow diagram of a MEMS switching sequence 50 according to the embodiments of the present invention. The MEMS switching sequence 50 includes initiating a switching of one or more of the one or more MEMS switches 10 in bank of MEMS switches 24 (step 51). In step 52, the power diverter 22 is activated by switching the power diverter 22 to the activated state, wherein the signal power 21 from the signal source 26 is either reflected or absorbed by the power diverter 22.

Step 54 of the MEMS switching method 50 includes waiting a sufficient time for the power diverter 22 to switch to the activated state. In step 55, the control signal CS2 is set to switch, or change, the switching state of one or more of the MEMS switches 10 in the bank of MEMS switches 24. The control signal CS2 switches one or more of the one or more MEMS switches 10 in bank of MEMS switches 24 from the OFF state to the ON state, or from the ON state to the OFF state. Step 56 of the MEMS switching method 50 includes waiting a sufficient time for the one or more MEMS switches 10 to settle. This settling time accommodates for the switching speed of the one or more MEMS switches 10 and for the bounce of the one or more MEMS switches 10. This settling time is typically less than approximately 10 uS, but the settling time can vary depending on the type of MEMS switches 10 included in the bank of MEMS switches 24. The power diverter 22 is then deactivated in step 57 by switching the power diverter 22 to the deactivated state, wherein signal power 21 from the signal source 26 is delivered to the bank of MEMS switches 24. Step 58 includes waiting a sufficient time for the power diverter 22 to switch to the deactivated state. In optionally included step 59, a switch valid flag is set at the end of the waiting in step 58. The control signals CS1, CS2 are sequenced via a controller, computer, or other processor, or via any other suitable circuit or system.

While the embodiments of the present invention have been illustrated in detail, it should be apparent that modifications and adaptations to these embodiments may occur to one skilled in the art without departing from the scope of the present invention as set forth in the following claims.

What is claimed:

1. A MEMS switching system, comprising:

a bank of MEMS switches; and a power diverter interposed between a signal source and the bank of MEMS switches, the power diverter having an activated state wherein signal power from the signal source is diverted from the bank of MEMS switches and a deactivated state wherein signal power from the signal source is not diverted from the bank of MEMS switches, the activated state and the deactivated state selected according to a control signal.

2. The MEMS switching system of claim 1 wherein the control signal selects the activated state prior to a switching of one or more MEMS switches in the bank of MEMS switches, and wherein the control signal selects the deactivated state after the switching of the one or more MEMS switches in the bank of MEMS switches.

3. The MEMS switching system of claim 1 wherein the bank of MEMS switches includes one or more MEMS switches configured within a MEMS-switched attenuator.

4. The MEMS switching system of claim 2 wherein the bank of MEMS switches includes one or more MEMS switches configured within a MEMS-switched attenuator.

5. The MEMS switching system of claim 1 wherein the power diverter includes at least one of a power absorbing device and power reflecting device.

6. The MEMS switching system of claim 1 wherein the power diverter in the activated state diverts sufficient signal power from the signal source to prevent signal power incident on each of one or more MEMS switches in the bank of MEMS switches from exceeding a pre-established threshold power level.

7. The MEMS switching system of claim 2 wherein the power diverter in the activated state diverts sufficient signal power from the signal source to prevent signal power incident on each of one or more MEMS switches in the bank of MEMS switches from exceeding a pre-established threshold power level.

8. The MEMS switching system of claim 3 wherein the power diverter in the activated state diverts sufficient signal power from the signal source to prevent signal power incident on each of one or more MEMS switches in the bank of MEMS switches from exceeding a pre-established threshold power level.

9. The MEMS switching system of claim 4 wherein the power diverter includes at least one stack of one or more diodes shunt coupled to a signal path between the signal source and the bank of MEMS switches.

10. The MEMS switching system of claim 4 wherein the power diverter includes at least one of a series FET coupled in a signal path between the signal source and the bank of MEMS switches, a shunt FET coupled to the signal path between the signal source and the bank of MEMS switches, and a series/shunt configuration of FET switches in the signal path between the signal source and the bank of MEMS switches.

11. A MEMS switching system, comprising:

selecting an activated state of a power diverter interposed between a signal source and a bank of MEMS switches prior to a switching of one or more of the MEMS switches in the bank of MEMS switches; and selecting a deactivated state of the power diverter after the switching of the one or more MEMS switches in the bank, wherein signal power from the signal source is diverted from the bank of MEMS switches in the activated state of the power diverter and wherein signal power from the signal source is not diverted from the bank of MEMS switches in the deactivated state of the power diverter.

12. The MEMS switching system of claim 11 wherein the bank of MEMS switches includes one or more MEMS switches configured within a MEMS-switched attenuator.

13. The MEMS switching system of claim 11 wherein the power diverter includes at least one of a power absorbing device and power reflecting device.

14. The MEMS switching system of claim 12 wherein the power diverter includes at least one of a power absorbing device and power reflecting device.

15. The MEMS switching system of claim 11 wherein the power diverter in the activated state diverts sufficient power from the signal source to prevent signal power incident on each of one or more MEMS switches in the bank of MEMS switches from exceeding a pre-established threshold power level.

16. The MEMS switching system of claim 12 wherein the power diverter in the activated state diverts sufficient power from the signal source to prevent signal power incident on each of one or more MEMS switches in the bank of MEMS switches from exceeding a pre-established threshold power level.

17. The MEMS switching method of claim 13 wherein the power diverter in the activated state diverts sufficient power from the signal source to prevent the signal power incident on each of one or more MEMS switches in the bank of MEMS switches from exceeding a pre-established threshold.

18. The MEMS switching system of claim 14 wherein the power diverter in the activated state diverts sufficient power from the signal source to prevent signal power incident on each of one or more MEMS switches in the bank of MEMS switches from exceeding a pre-established threshold power level.

19. The MEMS switching system of claim 11 wherein the power diverter includes at least one stack of one or more diodes shunt coupled to a signal path between the signal source and the bank of MEMS switches.

20. The MEMS switching system of claim 11 wherein the power diverter includes at least one of a series FET coupled in a signal path between the signal source and the bank of MEMS switches, a shunt FET coupled to the signal path between the signal source and the bank of MEMS switches, and a series/shunt configuration of FET switches in the signal path between the signal source and the bank of MEMS switches.

* * * * *